US009866944B1

(12) United States Patent
Wright

(10) Patent No.: US 9,866,944 B1
(45) Date of Patent: Jan. 9, 2018

(54) EXTERNAL SOUND HEADPHONES

(71) Applicant: Hyman Wright, Brooklyn, NY (US)

(72) Inventor: Hyman Wright, Brooklyn, NY (US)

( * ) Notice: Subject to any disclaimer, the term of this patent is extended or adjusted under 35 U.S.C. 154(b) by 0 days.

(21) Appl. No.: 15/244,082

(22) Filed: Aug. 23, 2016

(51) Int. Cl.
*H04R 25/00* (2006.01)
*H04R 1/10* (2006.01)
*H04R 5/033* (2006.01)

(52) U.S. Cl.
CPC ..... *H04R 1/1041* (2013.01); *H04R 5/0335* (2013.01)

(58) Field of Classification Search
CPC combination set(s) only.
See application file for complete search history.

(56) References Cited

U.S. PATENT DOCUMENTS 5,519,783 A 5/1996 Kumar
6,922,874 B2 * 8/2005 Gabathuler ..... H04R 25/602 16/242
8,023,663 B2 9/2011 Goldberg
8,243,943 B2 8/2012 Nordin
8,891,799 B2 * 11/2014 Fujikura ..... H04R 1/1091 381/309
2011/0206216 A1 8/2011 Brunner
2012/0140973 A1 * 6/2012 Olodort ..... H04R 1/1066 381/375
2013/0156247 A1 6/2013 Peter
2015/0281823 A1 * 10/2015 Taylor ..... H04R 1/1033 381/384
2017/0127168 A1 * 5/2017 Briggs ..... H04R 1/1066

FOREIGN PATENT DOCUMENTS

WO 9711573 A1 3/1997
WO 9914982 A1 3/1999

* cited by examiner

*Primary Examiner* — Amir Etesam

(57) ABSTRACT

The external sound headphones are a set of headphones with two earphones. Each of the earphones is formed with a port. The port is opened and closed with a hinged cover. When the hinged cover is opened, the port allows external sounds to pass freely through the earphone while the external sound headphones are in use. The port allows the wearer to monitor their environment while listening to the external sound headphones. The external sound headphones comprise a headband, a plurality of sliders, a plurality of earphones and a cable.

9 Claims, 6 Drawing Sheets

EXTERNAL SOUND HEADPHONES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of speakers and acoustic transducers, more specifically, headphones.

SUMMARY OF INVENTION

The external sound headphones are a set of headphones with two earphones. Each of the earphones is formed with a port. The port is opened and closed with a hinged cover. When the hinged cover is opened, the port allows external sounds to pass freely through the earphone while the external sound headphones are in use. The port allows the wearer to monitor their environment while listening to the external sound headphones.

These together with additional objects, features and advantages of the external sound headphones will be readily apparent to those of ordinary skill in the art upon reading the following detailed description of the presently preferred, but nonetheless illustrative, embodiments when taken in conjunction with the accompanying drawings.

In this respect, before explaining the current embodiments of the external sound headphones in detail, it is to be understood that the external sound headphones is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the external sound headphones.

It is therefore important that the claims be regarded as including such equivalent construction insofar as they do not depart from the spirit and scope of the external sound headphones. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
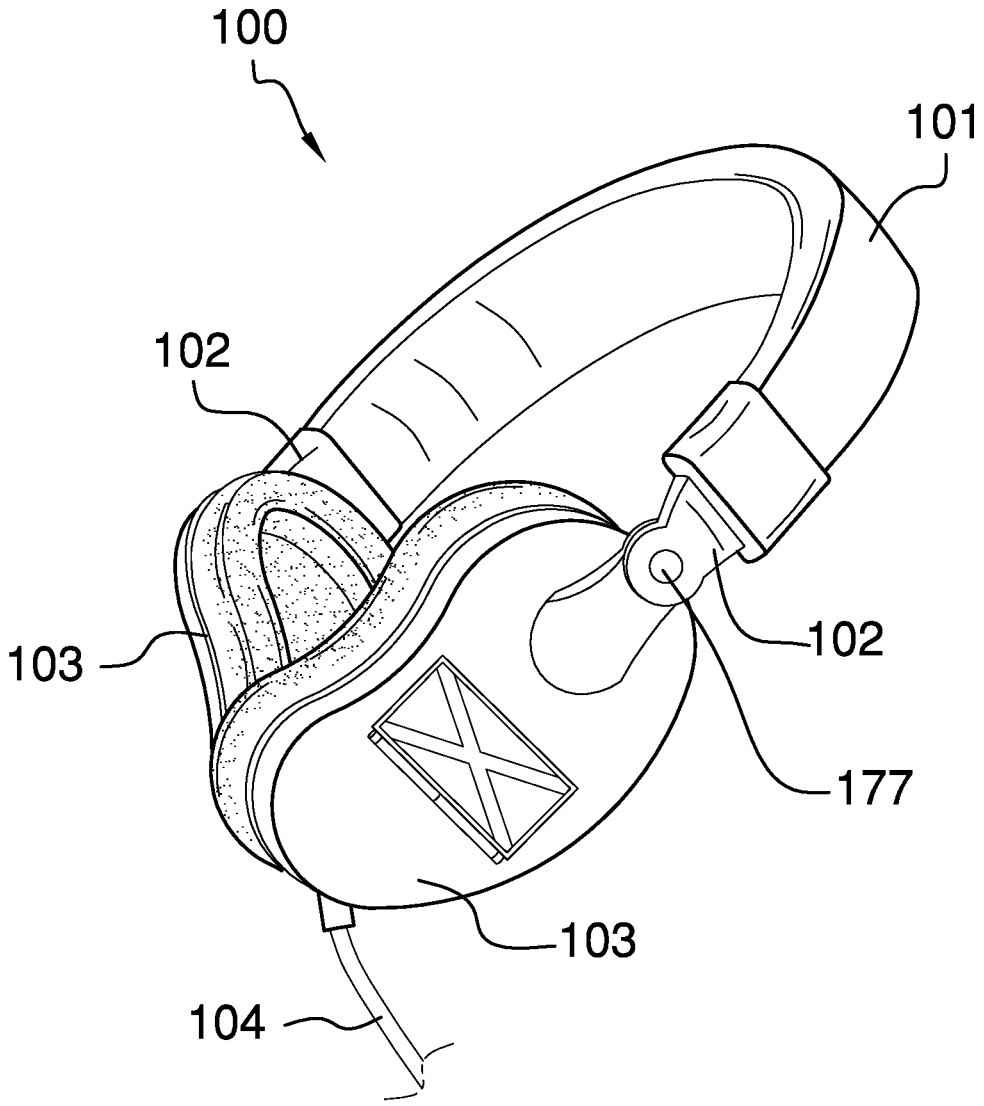
FIG. 1 is a perspective view of an embodiment of the disclosure.
Figure 2:
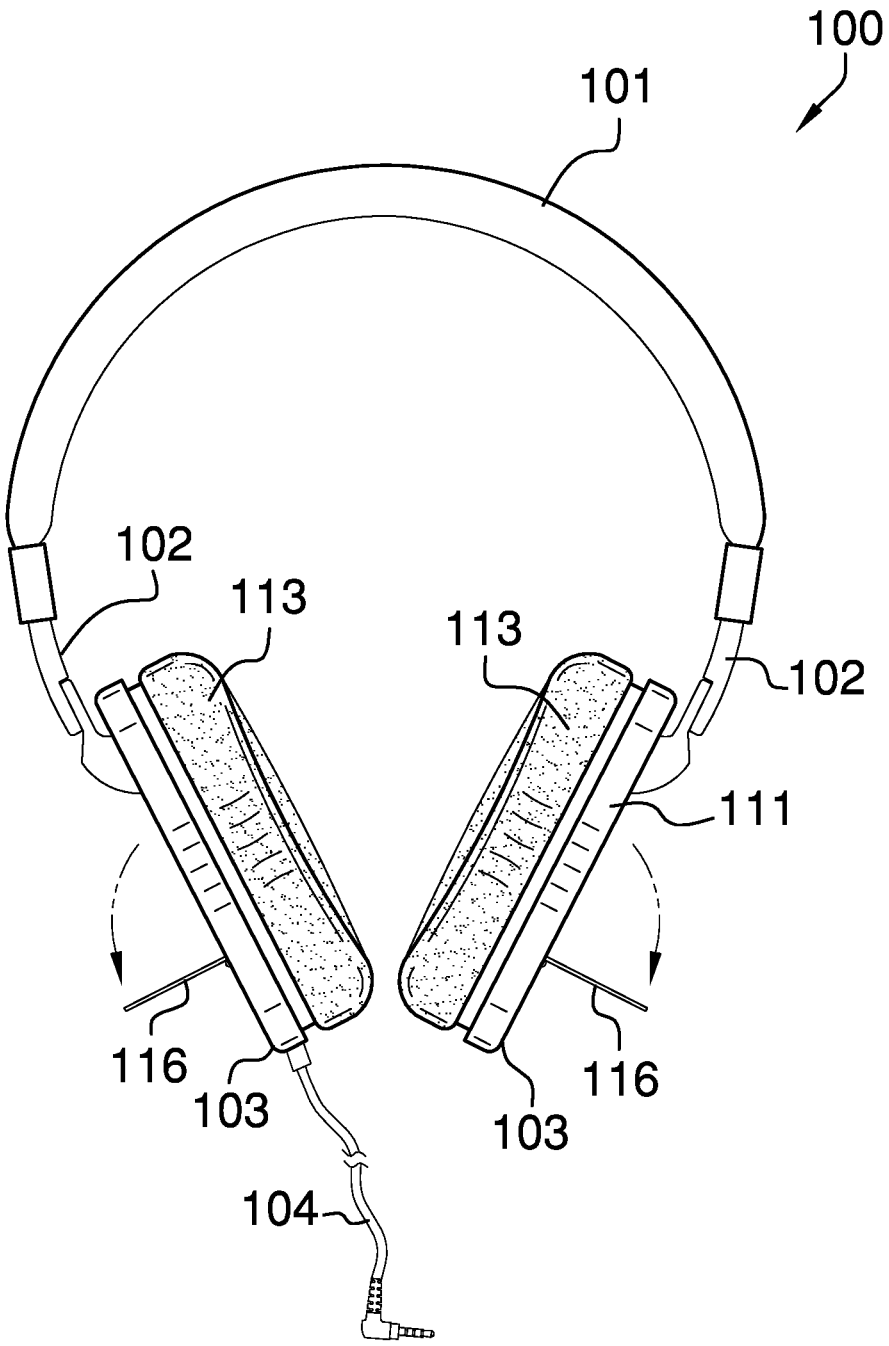
FIG. 2 is a front view of an embodiment of the disclosure.
Figure 3:
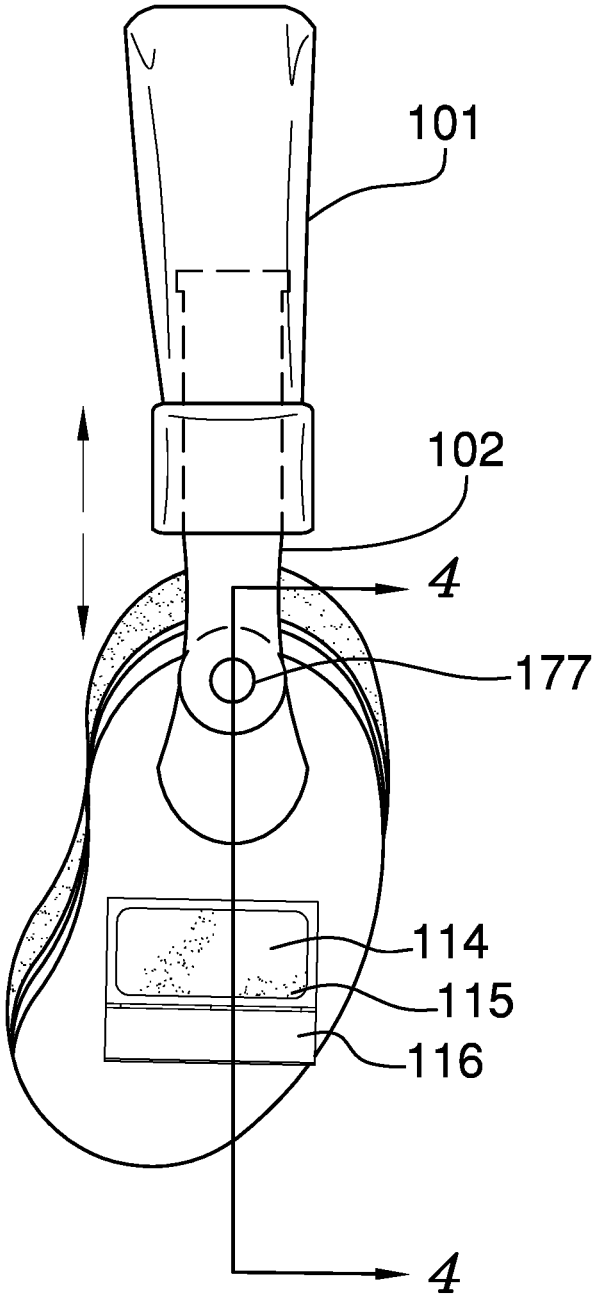
FIG. 3 is a side view of an embodiment of the disclosure.
Figure 4:
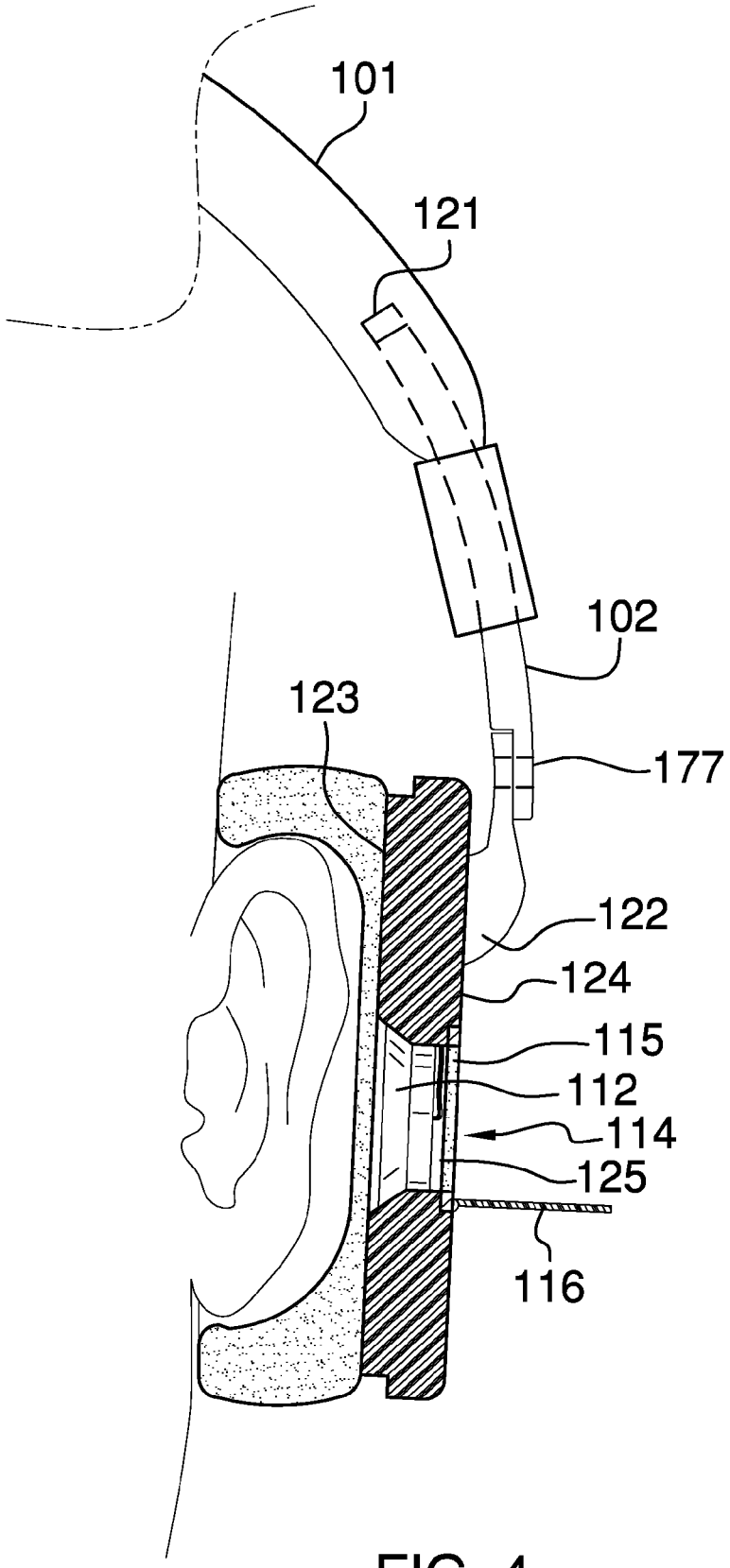
FIG. 4 is a cross-sectional view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7.

The external sound headphones 100 (hereinafter invention) comprises a headband 101, a plurality of sliders 102, a plurality of earphones 103 and a cable 104. The invention 100 is adapted for use in listening to audio sources. Each of the earphones is formed with a port 114. The port 114 is opened and closed with a hinged cover 116. When the hinged cover 116 is opened, the port 114 allows external sounds to pass freely through the earphone while the invention 100 is in use. The port 114 allows the wearer 131 to monitor the environment while listening to the external sound headphones.

The headband 101 is a hollow structure that is used to hold the invention 100 on the head 132 of the wearer 131. The purpose of each of the plurality of sliders 102 is to allow for the adjustment of the positioning of each of the plurality of earphones 103 relative to the headband 101. Each of the plurality of sliders 102 is a flat spring that is associated with an earphone selected from the plurality of earphones 103. Each of the plurality of sliders 102 further comprises a first end 121 and a second end 122. The first end 121 of each of the plurality of sliders 102 is inserted into the hollow portion of the headband 101. The second end 122 of the each of the plurality of sliders 102 is attached to the earphone selected from the plurality of earphones 103 that is associated with the selected slider. By sliding a slider selected from the plurality of sliders 102 into and out of the headband 101 the positioning of each of the plurality of earphones 103 relative to the headband 101 can be adjusted. In the first potential embodiment of the disclosure, as most clearly shown in FIGS. 1, 3, and 5, a cable 104 is used to connect the invention 100 to an audio source. In a second potential embodiment of the disclosure, the cable 104 is replaced by a Bluetooth connection.

Each of the plurality of earphones 103 further comprises a frame 111, a speaker 112, a seal 113, a port 114, a mesh 115, and a hinged cover 116. The frame 111 is a rigid structure that the remainder of the components of the frame 111 are attached to. The frame 111 if further defined with a first surface 123 and a second surface 124. The speaker 112 converts electrical signals received from the audio source into audible sound. In the first potential embodiment of the disclosure, the speaker 112 is wired to the cable 104 in order to receive these electric signals. Methods to wire speakers to audio sources are well known and documented in the electrical arts. The speaker 112 is mounted to the first surface 123 of the frame 111. The seal 113 is a pad that is attached to the perimeter of the first surface 123 of the frame 111. The pad of the seal 113 is covered with a sheeting. The purpose of the seal 113 is to hold the each of the plurality of earphones 103 securely to the head 132 of the wearer 131. The seal 113 is pressed against the head 132 of the wearer 131 by the tension supplied by each of the plurality of sliders 102.

The port 114 is an aperture formed through the frame 111 that forms a channel 125 from the first surface 123 to the second surface 124. The mesh 115 covers the port 114. The mesh 115 is a mesh fabric that prevents objects from entering the earphone selected from the plurality of earphones 103 when the port 114 is in use. The port 114 is covered with the hinged covered 116. The hinged cover 116 is a barrier that is used to open and close the port 114. The hinged cover 116 is attached to the second surface 124 of the frame 111 such that the hinged cover 116 can rotate around a pivot that is formed by a hinge 117. When the hinged cover 116 is positioned such that it blocks access to the port 114, exterior sound is prevented from entering the earphone selected from the plurality of earphones 103. When the hinged cover 116 is positioned in the open position, exterior sound can enter the earphone selected from the plurality of earphones 103.

Figure 5:
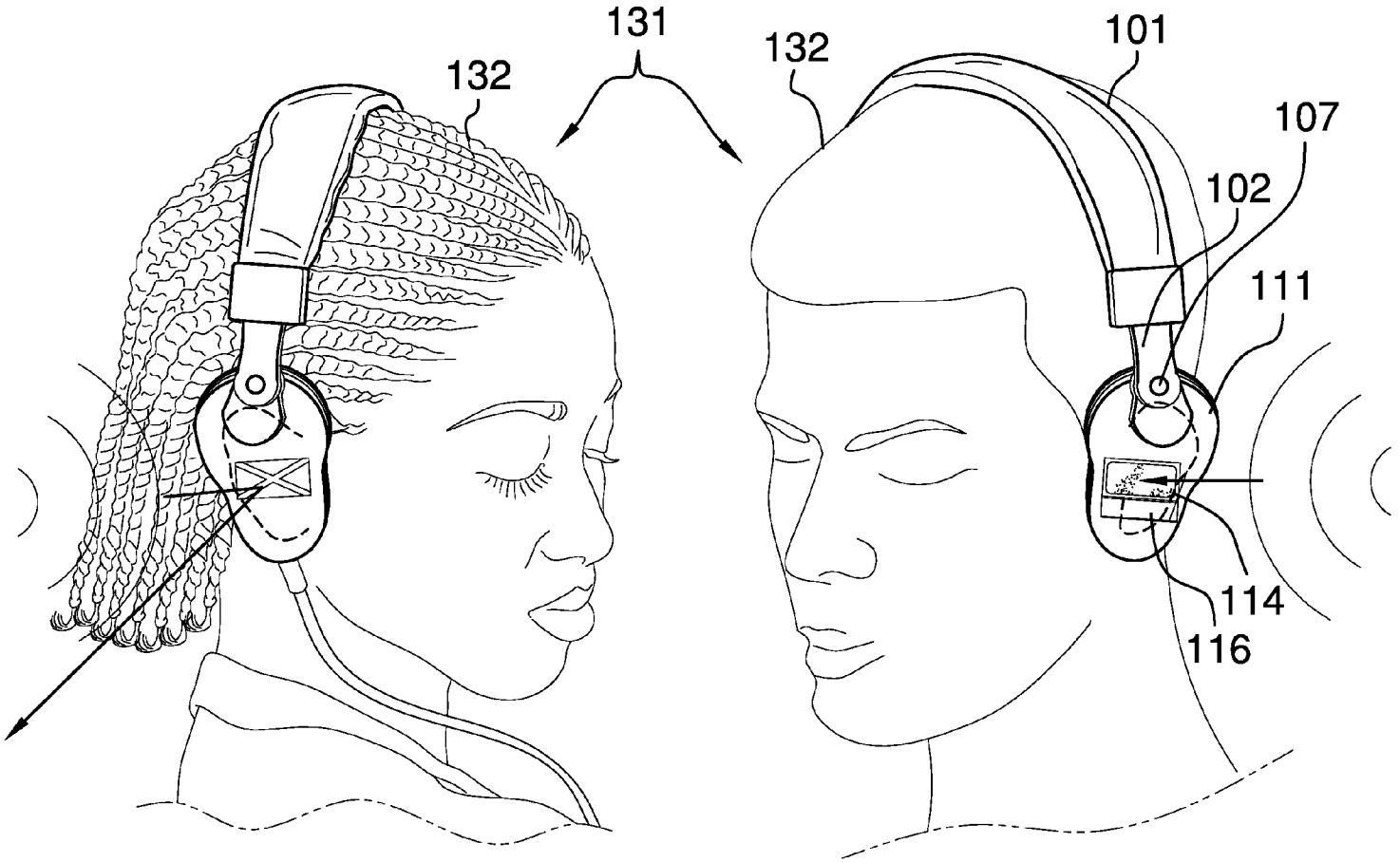
FIG. 5 is an in use view of an embodiment of the disclosure.
Figure 6:
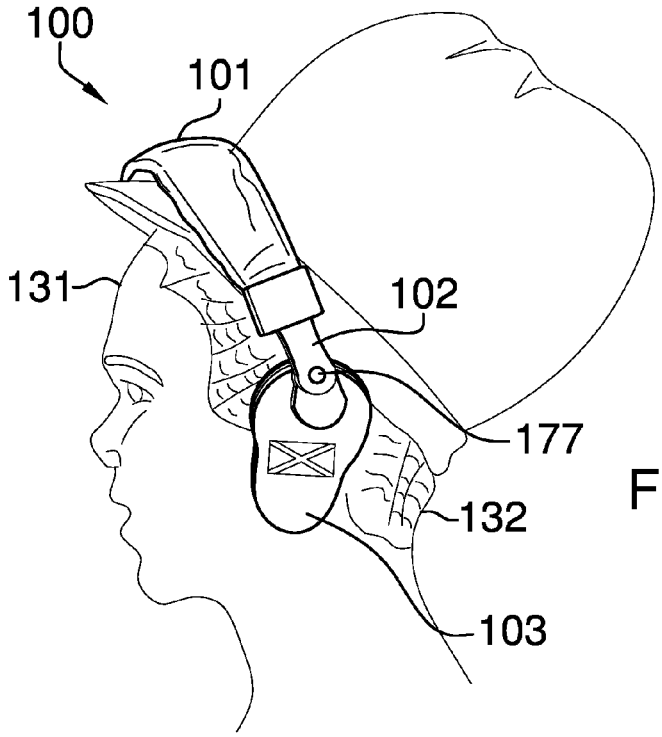
FIG. 6 is a side view of an embodiment of the disclosure in use.
Figure 7:
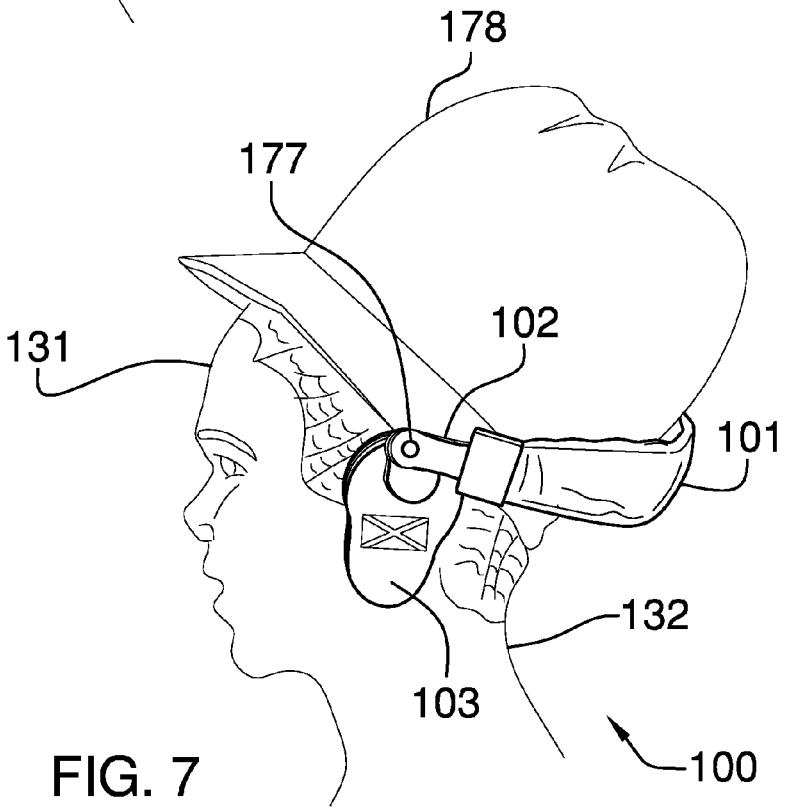
FIG. 7 is a side view of an embodiment of the disclosure in use.

As shown in FIGS. 1 and 5, the port 114 can be further decorated with adornments such as national flags or corporate logos. In the third potential embodiment of the disclosure, the hinged cover 116 is formed with a latch to hold the port 114 in the closed position. In the fourth potential embodiment of the disclosure, the hinge 117 of the hinged cover 116 is fitted with a spring to hold the hinged cover 116 in the closed position. Methods to design and install latches are well known and documented in the mechanical arts. Methods to incorporate springs into hinges are well known and documented in the mechanical arts.

In each of the potential embodiments discussed in this disclosure: 1) the plurality of sliders 102 further comprises a left slider 141 and a right slider 142; and, 2) the plurality of earphones 103 further comprises a left earphone 143 and a right earphone 144.

To use the invention 100, the invention 100 is donned and used as a traditional headphone. When the wearer 131 wants to hear external sounds, the hinged cover 116 is rotated such that the port 114 is opened allowing the exterior sounds to enter the earphone selected from the plurality of earphones 103. The wearer 131 can rotate the hinged cover 116 to block the port 114 when they no longer want to hear the external sounds.

The plurality of earphones 103 attach to the plurality of sliders 102 via a pivoting member 177. The pivoting member 177 enables both the headband 101 and the plurality of sliders 102 to rotate relative the plurality of earphones 103. Moreover, the plurality of earphones 103 rotate relative the headband 101 and the plurality of sliders 102 to accommodate the head 132 of the wearer 131. Moreover, in referring to FIGS. 6-7, the wearer 131 may have a large head garment 178, which require the headband 101 to be forward or rearward thereof.

The frame 111 and port 114 are custom made from molded plastic. Suitable plastics include, but are not limited to, high density polyethylene or polycarbonate. The remaining components discussed in this disclosure are commercially available.

The following definitions were used in this disclosure:

Audio File: As used in this disclosure, an audio file is a digital representation of a sound that is used to store a recording of the sound. Separate hardware is used to convert the digital representation of the sound into an audible sound.

Audio Source: As used in this disclosure, an audio source is a device that generates electrical signals that can be converted in to audible sounds by a speaker.

Cable: As used in this disclosure, a cable is a collection of insulated wires covered by a protective casing that is used for transmitting electricity or telecommunication signals.

Earphone: As used in this disclosure, an earphone refers to a device that converts electrical signals into audible sounds that are worn or listened to in contact with the ear.

Flat Spring: As used in this disclosure, a flat spring is a device designed to store and release mechanical energy that is made of a flat of conical piece of material.

Headphone: As used in this disclosure, a headphone is a device that comprises one or two earphones that are held to the ear, typically through the use of a band placed on top of the head. Headset is a synonym for headphone.

Hinge: As used in this disclosure, a hinge is a device that permits the turning, rotating, or pivoting of a first object relative to a second object.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Pad: As used in this disclosure, a pad is a mass of soft material used as a filling or for protection against damage or injury.

Pivot: As used in this disclosure, a pivot is a rod or shaft around which an object rotates or swings.

Sheeting: As used in this disclosure, sheeting is a material, such as cloth or plastic, in the form of a thin flexible layer or layers.

Speaker: As used in this disclosure, the term a speaker is an electrical device that converts an electrical signal into an audible sound.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An acoustic system comprising:

a headband, a plurality of sliders, a plurality of earphones, and a cable;

wherein the acoustic system is adapted for use in listening to audio sources;

wherein each of the earphones is formed with a port;

wherein each port is opened and closed with a hinged cover;

wherein when the hinged cover is opened, the port allows external sounds to pass freely through the earphone while the acoustic system is in use;

wherein the port allows the wearer to monitor the environment while listening to the external sound headphones;

wherein the headband is a hollow structure;

wherein each of the plurality of sliders is a flat spring;

wherein each of the plurality of sliders further comprises a first end and a second end;

wherein the first end of each of the plurality of sliders is inserted into the hollow portion of the headband;

wherein the second end of the each of the plurality of sliders is attached to the earphone selected from the plurality of earphones that is associated with the selected slider;

wherein each of the plurality of earphones further comprises a frame, a speaker, a seal, a port, a mesh, and a hinged cover;

wherein the frame is a rigid structure;

wherein the frame is further defined with a first surface and a second surface;

wherein the speaker converts electrical signals received from the audio source into audible sound;

wherein the speaker is mounted to the first surface of the frame;

wherein the seal is a pad that is attached to the perimeter of the first surface of the frame;

wherein the seal is pressed against the head of the wearer by the tension supplied by each of the plurality of sliders;

wherein the port is an aperture formed through the frame that forms a channel from the first surface to the second surface.

2. The acoustic system according to claim 1 wherein a cable is used to connect the acoustic system to an audio source.

3. The acoustic system according to claim 1 wherein a Bluetooth connection is used to connect the acoustic system to an audio source.

4. The acoustic system according to claim 1 wherein the mesh covers the port.

5. The acoustic system according to claim 4 wherein the port is covered with the hinged covered.

6. The acoustic system according to claim 5 wherein the hinged cover is attached to the second surface of the frame such that the hinged cover can rotate around a pivot that is formed by a hinge.

7. The acoustic system according to claim 6 wherein the port is be further decorated with adornments.

8. The acoustic system according to claim 7 wherein the plurality of sliders further comprises a left slider and a right slider;

wherein the plurality of earphones further comprises a left earphone and a right earphone;

wherein the frame and port are formed from plastic selected from the group consisting of polyethylene or polycarbonate.

9. The acoustic system according to claim 8 wherein the plurality of earphones attach to the plurality of sliders via a pivoting member; wherein the pivoting member enables both the headband and the plurality of sliders to rotate relative the plurality of earphones; wherein the plurality of earphones rotates relative the headband and the plurality of sliders to adaptively accommodate the head of the wearer; wherein the pivoting member of each of the plurality of earphones enable the headband to be adapted to be positioned forward or rearward of the head of said wearer.

* * * * *